US005815970A

United States Patent [19]

Thalenfeld et al.

[11] Patent Number: 5,815,970

[45] Date of Patent: Oct. 6, 1998

[54] MERCHANDISE DISPLAY HOOK WITH VIEWING ANGLE ADJUSTMENT FOR PIVOTING LABEL HOLDER

[75] Inventors: David R. Thalenfeld, Bear Creek; John S. Thalenfeld, Dallas, both of Pa.; Thomas O. Nagel, Blairstown, N.J.

[73] Assignee: Trion Industries, Inc., Wilkes-Barre, Pa.

[21] Appl. No.: 871,238

[22] Filed: Jun. 9, 1997

[51] Int. Cl.[6] ..... G09F 3/00

[52] U.S. Cl. ..... 40/642.01; 40/658; 211/57.1; 211/59.1; 248/291.1

[58] Field of Search ..... 40/642.01, 642.02, 40/657, 658, 661.03; 211/57.1, 59.1; 248/291.1, 286.1

[56] References Cited

U.S. PATENT DOCUMENTS

| | | | |
|---|---|---|---|
| 161,517 | 3/1875 | Keam | 40/658 X |
| 4,217,986 | 8/1980 | Brown | 211/57.1 |
| 4,540,093 | 9/1985 | Merl et al. . | |
| 4,798,297 | 1/1989 | Weiss et al. | 211/59.1 X |
| 4,801,116 | 1/1989 | Blankenship . | |
| 4,821,437 | 4/1989 | Abramson et al. . | |
| 5,088,606 | 2/1992 | Boas . | |
| 5,235,766 | 8/1993 | Fast et al. . | |
| 5,348,167 | 9/1994 | Jensen . | |
| 5,456,034 | 10/1995 | Lewis et al. . | |
| 5,485,930 | 1/1996 | Rushing | 211/59.1 |
| 5,702,008 | 12/1997 | Thalenfeld et al. | 211/57.1 |

FOREIGN PATENT DOCUMENTS

| | | | |
|---|---|---|---|
| 314238 | 6/1929 | United Kingdom | 248/291.1 |
| 9310516 | 5/1993 | WIPO . | |

*Primary Examiner*—Brian K. Green
*Assistant Examiner*—Andrea Chop
*Attorney, Agent, or Firm*—Schweitzer Cornman Gross & Bondell LLP

[57] ABSTRACT

A merchandise display hook is provided with an adaptor to adjust the at-rest viewing angle of a pivoting label holder of a merchandise display hook. The adaptor mounts to the end of the label support arm and contacts the back panel of the label holder to alter the at-rest viewing angle. In one embodiment, the adaptor has a slidable gripping portion for slidable mounting on the label support arm and an abutment section for contacting the back panel of the label holder. In another embodiment, the adaptor mounts on the cross bar of the label holder arm and has an alternate cross bar for pivotal support of the label holder. The adaptor is configured to alter the at-rest viewing angle of the label holder.

5 Claims, 2 Drawing Sheets

MERCHANDISE DISPLAY HOOK WITH VIEWING ANGLE ADJUSTMENT FOR PIVOTING LABEL HOLDER

RELATED APPLICATIONS

This application is related to co-pending U.S. applications Ser. No. 08/640,336, Ser. No. 08/681,008, Ser. No. 08/681,009 and Ser. No. 08/681,012, owned by Trion Industries, Inc., of Wilkes-Barre, Pa.

BACKGROUND AND SUMMARY OF THE INVENTION

Display hooks, typically mounted on apertured panel board, slotted panels, supporting cross-bars or the like are in widespread usage for displaying carded merchandise for sale. In many cases, such merchandise display hooks are combined with label-mounting means for presenting product information and pricing in association with the carded merchandise. A common form of such label-mounting means consists of an arm projecting above and generally parallel to a merchandise supporting arm and mounting a label-holding device at its forward extremity, advantageously in a position directly in front of the outer end of the merchandise display hook. The label-holding device, in such cases, serves an additional function as a means for guarding the outer end of the display hook element against accidental contact.

One of the known label-mounting means for this purpose comprises a wire-like label support arm extending outward, above the merchandise support, and terminating at its outer extremity in a welded-on cross bar element. The cross bar element serves as a pivoting support for a plastic label holder, allowing the label holder to hang downward in front of the outer end of the merchandise support. The pivoting action of the label holder facilitates product removal from the associated product support. If a product being withdrawn forwardly from its display hook engages the plastic label holder, the holder can simply pivot upward out of the way as necessary to allow the product to clear. An additional advantage of pivoting label holders in general is that, with respect to product items displayed at a low level, viewing of the product information and pricing is facilitated by allowing the customer to simply reach down and tilt the label holder upwardly, rather than having to bend or crouch to read the contents of the label.

As is explained in the inventor's above-mentioned U.S. co-pending U.S. application Ser. No. 08/640,336, the cross bar is preferably welded to an upper surface of the label support arm. One of the advantages of this arrangement, over welding the cross bar directly to the end face of the label support arm is that the welding procedure (typically electrical resistance welding) is much more reliable and cost efficient. In addition, the arrangement allows the label holder to pivot upward through a greater angle.

To enhance visibility of the label, it is desirable that the at-rest viewing angle of the label holder be slightly inclined. The optimum viewing angle depends on the vertical position of the products on the display. For example, for product rows which are along the top of the display, it is typically desirable that the at-rest viewing angle be only slightly inclined. For products along the bottom, however, a greater inclination is often desired.

Pursuant to the teachings of our co-pending application Ser. No. 08/640,336, the angle of inclination of a label holder is controlled by the position of the cross bar relative to the end of the label support arm. By spacing the cross bar a predetermined distance inwardly from the end of the label support arm, the back panel of the label holder, upon downward rotation of the label holder about the cross bar, will contact the end of the label support arm, thereby limiting the downward rotation of the label holder such that it will come to rest in an upwardly inclined position. The degree of upward inclination of the at-rest label holder is a function of the distance by which the label support arm extends beyond the cross bar. In our prior designs this distance is fixed, therefore the at-rest angle is also fixed.

The present invention is directed to a merchandise display hook of the general type described above, including a pivoted label holder arrangement, which is improved with respect to known constructions. To this end, the device of the invention includes an adaptor which mounts on either the cross bar element or on the label support arm, for pivotal support of a label holder at a variety of angles. In one form of the invention, an adaptor has cross bar engaging clips for snap-on frictional engagement with the existing cross bar of a merchandise display hook. The adaptor has a cross bar sized and shaped similar to the cross bar attached to the label support arm for pivotal support of the label holder. The distance between the cross bar of the adaptor and the forward end thereof advantageously is greater than the distance between the cross bar attached to the label supporting arm and the end extremity of the label support arm. Thus, when the adaptor is mounted on the cross bar of the label support arm, the label holder will be supported at an increased angle of upward inclination. As can be appreciated, the adaptor can be designed in various configurations to provide various (and possibly even decreased) at-rest viewing angles for the label holder, to enable optimum viewing of label holders mounted at various viewing heights.

In an alternative form of the invention, an adaptor attaches to the label support arm, preferably extending rearwardly of the cross bar fixed thereto. The adaptor includes a gripping portion, for frictionally and slidably gripping the label support arm, and an abutment section which extends forwardly along the end extremity of the label support arm. The abutment section is sized such that it can be positioned to extend beyond the end extremity of the label support arm and contact the back panel of the label holder to increase the at-rest viewing angle. The extent by which the abutment section extends beyond the label support arm can be changed by sliding the adaptor inward or outward along the label support arm. Thus, the adaptor can provide an infinite number of at-rest viewing angles.

It can be appreciated that the present invention provides significant efficiencies because previously existing and installed merchandise display hooks, having fixed at-rest viewing angles for the label holders, can be easily and inexpensively modified to provide different or even adjustable at-rest viewing angles. This enhances product displays by enabling the viewing angles to be adjusted according to the height of the hooks in relation to the height of an average viewer.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figures 1, 2:
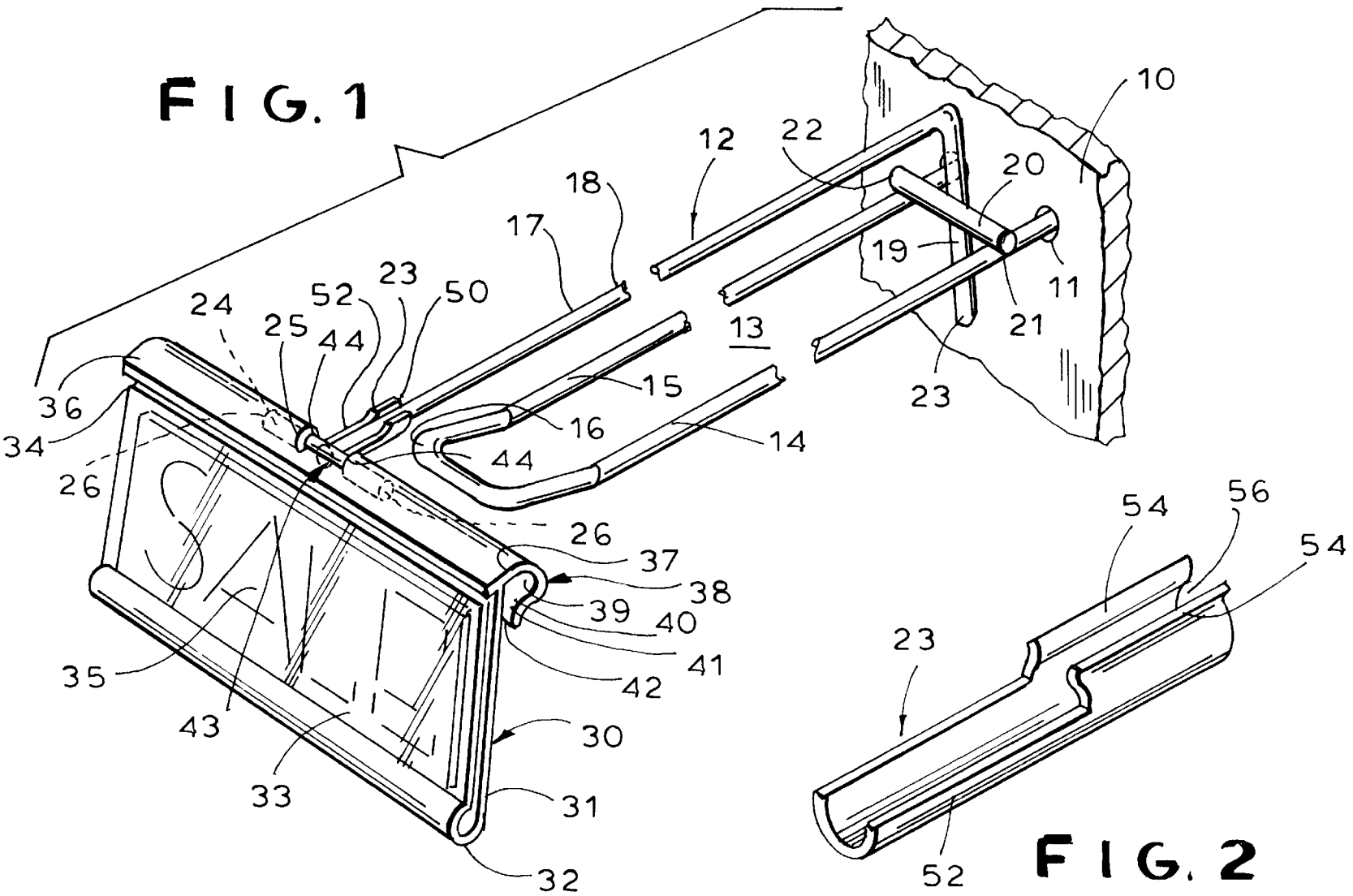
FIG. 1 is a perspective view of a first preferred embodiment of a merchandise display hook according to the invention, in the form of a slidably adjustable adaptor.
FIG. 2 is an enlarged, perspective view, of the sliding adaptor depicted in FIG. 1.
Figure 3:
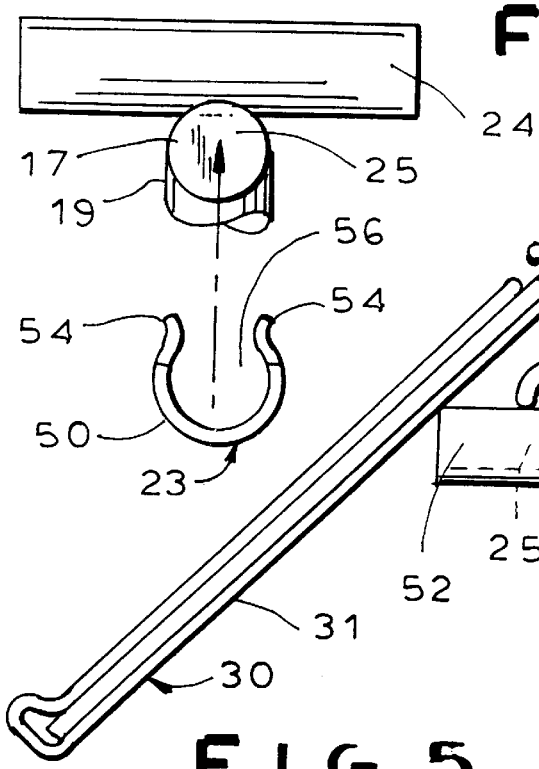
FIG. 3 is an exploded front elevational view of the first embodiment illustrating the sliding adaptor as shown in FIG. 2 mounting on a label support arm.

Referring now to the drawing, and specifically to FIG. 1 thereof, a merchandise display hook 12 is conventionally provided with mounting lugs (not shown) which are inserted through an adjacent pair of apertures 11 in an apertured panel board 10 in order to support the merchandise hook 12 in the manner illustrated in FIG. 1, with operative portions of the display hook extending outward from the face of the panel board. While the merchandise display hook 12 is shown with mounting means suitable for an apertured panel board, it can be appreciated that mounting means suitable for other supporting structure, such as slotted panels or supporting cross-bars, can be used.

The hook 12 includes a merchandise supporting element 13 which can be in the form of a loop hook or other suitable configuration, such as straight length of wire. The loop hook form of the merchandise supporting element 13 comprises outwardly extending parallel wire supports 14, 15, joined at the outer end by a U-shaped bend 16. L-shaped mounting lugs (not shown) are provided at the innermost end extremities of the wire sections 14, 15. A label supporting arm 17 extends above and generally parallel to the merchandise support 13, with the outer end portion 18 of the arm 17 positioned slightly beyond and slightly above the end extremity 16 of the merchandise supporting loop hook 12. At its inner end, the label support 17 can have a downwardly extending leg 19 which is welded to a transverse cross bar 20. The cross bar 20 is in turn welded to the respective legs 14, 15 of the loop hook, as indicated at 21, 22. The lower end extremity 23 of the leg 19 can project below the level of the loop hook so as to engage the front surface of the apertured panel 12 and serve as a support to maintain the generally horizontal orientation of the merchandise support 12.

A label supporting cross bar 24 is welded to the upper surface of the outer end portion 18, at a point spaced above and rearwardly of the outer end face 25 of the wire end section 18. As shown particularly in FIGS. 1 and 2, the cross bar 24 is mounted symmetrically on the wire section 17, with end portions 26 thereof, extending laterally on each side.

Whereas in accordance with the disclosure of our prior U.S. application Ser. No. 08/640,336, the at-rest viewing angle of the label holder 30 is fixed by the relationship of the cross bar to the outer end face 25, it is a feature of the present invention that an adaptor 23 is provided to modify the merchandise display hook so as to allow for a plurality of at-rest viewing angles of the label holder 30. It can be appreciated that significant improvements and economies are realized through the ability to optimize viewing angles of label holders mounted on previously manufactured and/or installed hooks thereby preserving capital investments and avoiding replacement costs.

A s depicted in FIG. 1, the label holder 30 mounted on the cross bar 24 is preferably formed of plastic and may in large part be of known design and construction. It is preferably of extruded or coextruded semi-rigid, plastic construction and comprises a flat back panel 31 joined along a bottom edge 32 with a clear front panel 33. The front and back panels 33, 31, and the bottom connection 32 are so arranged that the front panel tends to close elastically against the front face of the back panel 31. However, by pressing rearwardly against the bottom portion 32, the upper lip 34 of the front panel can be sprung forward from the back panel 31 to accommodate the placement and retrieval of product information and pricing labels 35.

Desirably, a forwardly projecting guard flange 36 is provided along the upper edge of the back panel 31, to normally overlie the upper edge 34 of the front panel. A hinge-forming flange 37 projects rearwardly from the upper edge of the back panel 31 an d includes a U-shape d retaining clip portion 38 defining a forwardly facing U-shaped recess 39 of a size to receive the cross bar element 24. At its lower edge extremity 40, the U-shaped flange portion 38 is bent sharply downward and rearward, and supports an integral, downwardly divergent guide flange 41.

As set forth in the applicant's co-pending U.S. application Ser. No. 08/681,009, the guide flange 41 advantageously is angled downwardly at about 45° with respect to the plane of the back panel 31 and extends for a sufficient distance to provide a relatively wide entrance 42 through which the cross bar 24 may be pressed when installing the label holder on the cross bar. Thus, by placing the guide flange 41 in contact with a cross bar 24 and pressing downward on the top of the retaining flange 37, the lower portion of the retaining flange will be cammed open by the guide flange 41. As soon as the cross bar 24 enters the chamber 39, the retaining flange 37 elastically closes so that the label holder is reliably connected to the cross bar 24 while being free to pivot with respect thereto.

The flange 37, the retaining clip portions 38, and the guide flange 41 are slotted at 43, in the center of the label holder, so that inner side edges 44 of the slotted portion straddle the wire end section 18, and serve to maintain the label holder properly centered with respect to the label support arm 17.

The sliding adaptor 23 shown in FIGS. 1–4 has a gripping portion 50 adapted to frictionally and slidably grip the label support arm 17. The adaptor 23 also has an abutment section 52 extending from the gripping portion 50, which abutment section is adapted to extend along the label support arm 17 and contact the back panel 31 of the label holder 30.

The at-rest viewing angle of the label holder 30 can be altered by sliding the adaptor 23 along the label support arm to adjust the distance by which the abutment section 52 extends beyond the cross bar 24. To increase the at-rest viewing angle, the adaptor 23 is moved forward to extend the abutment section 52 a greater distance beyond the end extremity 18 of the label support arm 17. To decrease the at-rest viewing angle, the adaptor 23 is moved rearward. The effect of the adaptor 23 can be eliminated by moving the adaptor 23 to a position where the abutment section 52 does not extend beyond the end face 25 of the label support arm 17.

Referring to FIG. 2, the adaptor 23 is preferably extruded in a generally U-shaped configuration. The gripping portion

50 preferably has outwardly-turned guide flanges 54 forming a relatively narrow entry gap 56 for facilitating snap-on mounting on the label support arm (not shown). The abutment section 52 is preferably an integral extension of the gripping portion 50, with upper portions, including guide flange portions, removed to avoid contacting the cross bar 24. As shown, the abutment section 52 can have a semi-circular cross section such that, when the adaptor 23 is mounted, the abutment section 52 conforms to, and extends along, the underside of the label support arm 17.

Figure 4:
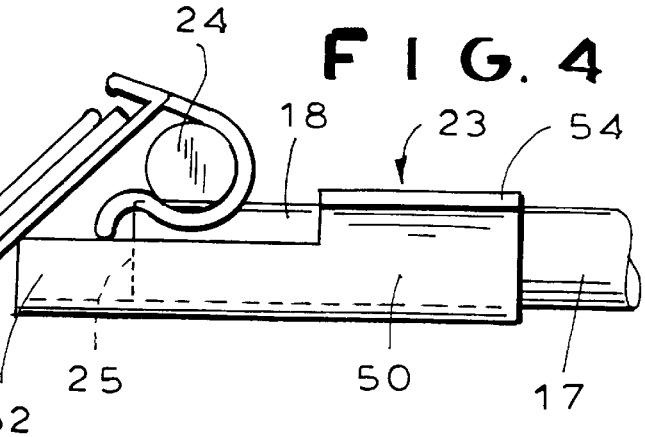
FIG. 4 is a side elevational view of the merchandise display hook of FIG. 1, illustrating the sliding adaptor holding the label holder in an upwardly inclined position.

Referring to FIG. 4, the sliding adaptor 23 is preferably configured such that the gripping portion 50 mounts inwardly of the cross bar 24 and extends above a portion of the cross bar 24 such that the gripping portion 52 can contact the cross bar 24 so as to prevent the adaptor 23 from sliding off of the label support arm 17. Thus, the adaptor 23 provides an infinite number of at-rest viewing angles for the label holder 30 between an upper and lower limit. The lower limit is determined by the relative positions of the cross bar and the end 25 of the label support arm 17. The upper limit of the at-rest position provided by the adaptor 23 is determined by the distance by which the abutment section can extend beyond the end face 25.

Figure 5:
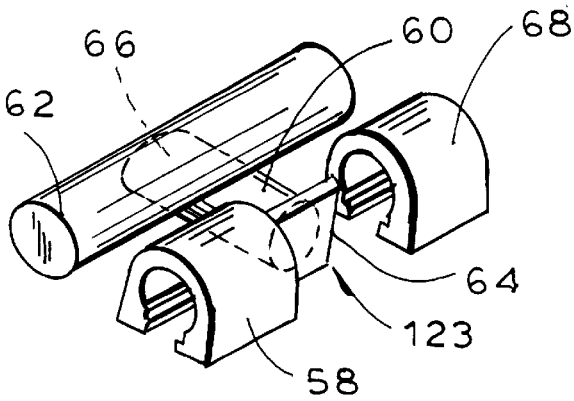
FIG. 5 is a perspective view of a second preferred embodiment of the invention, in the form of a snap-in adaptor.
Figure 6:
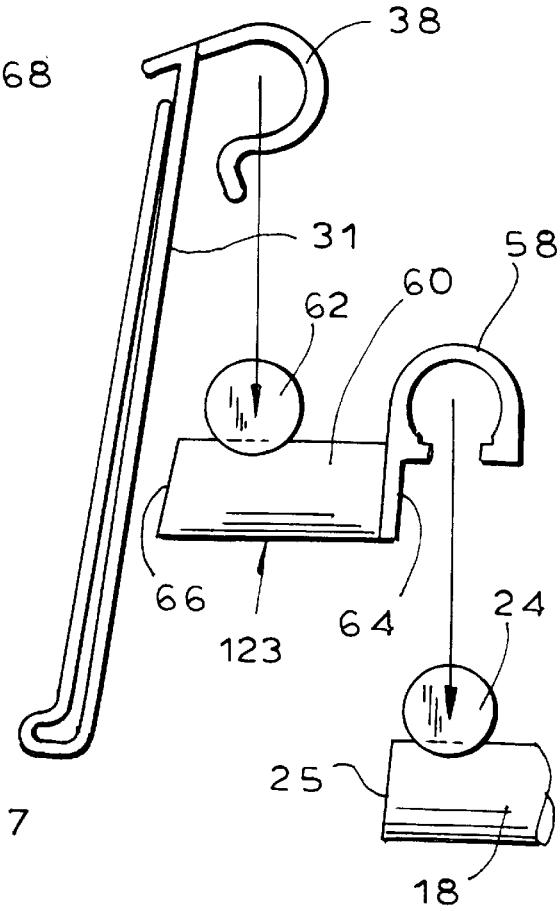
FIG. 6 is an exploded, side elevational view of the second embodiment illustrating the mounting adaptor depicted in FIG. 5 mounting on a cross bar.
Figure 7:
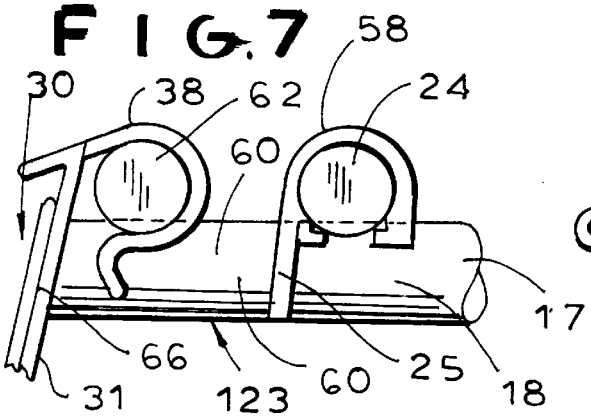
FIG. 7 is an assembled side elevation view of the device as shown in FIG. 6.

Referring to FIGS. 5–7, an alternative embodiment of the invention, which advantageously can be formed by injection molding, includes a mounting adaptor 123 with cross bar engaging clip portions 58 for mounting on the cross bar 24 of the merchandise display hook 10. A body 60 extends forward from the clip portions 58 and supports an alternate cross bar 62 sized and shaped similar to the cross bar 24 mounted on the label support arm 17, for pivotal support of a label holder 30. The alternate cross bar 62 is preferably aligned in a horizontal plane with the cross bar 24 such that the adaptor 123 does not substantially change the vertical position of the label holder 30.

The retaining clip portions 58 of the mounting adaptor 123 are adapted for tight frictional engagement with the cross bar 24 such that, when mounted, the adaptor 123 resists rotation about cross bar 24. In addition, the body 60 has a rear portion 64 adapted to abut the end face 25 of the end 18 of the label holder arm 17 to prevent downward rotation (clockwise in FIG. 5) of the adaptor 123.

The alternate cross bar 62 is spaced inwardly from the front end 66 of the body 60, which front end 66 is adapted to contact the back panel 31 of the label holder 30 to maintain the label holder 30 in a predetermined upwardly inclined at-rest viewing angle. Preferably, the alternate cross bar 62 is spaced from the front end 66 of the body 60 a greater distance than that between the cross bar 24 and end face 25 of the label support arm 17 such that the mounting adaptor 123 serves to increase the at-rest viewing angle of the label holder 30. However, as can be appreciated, the adaptor 123 can be designed to decrease the at-rest viewing angle by altering the position of the alternate cross bar 62 relative to the front end 66. Also, the front end 66 of the body portion 60 can be formed with a surface parallel to the back panel 31 of the label holder 30 when in the at-rest position such that substantially the entire surface contacts the back panel 31 of the label holder 30.

In any of its forms, the device of the invention enables a merchandiser to customize its displays by positioning pivoted label holders at convenient viewing angles according to the elevation at which the display hooks are mounted. For hooks along the lower rows, well below the viewing height of a typical purchaser, the label holders may be supported at a greater upward inclination than for hooks mounted at higher levels.

It should be understood, of course, that the specific form of the invention herein illustrated and described is intended to be representative only. In this respect, the specific form of the merchandise display hook employing the new label-mounting feature may take any of a variety of forms. Likewise, the plastic label holder itself may be constructed in various ways consistent with the present invention. Accordingly, reference should be made to the following appended claims in determining the full scope of the invention.

We claim:

1. A merchandise display hook, comprising (a) an outwardly extending label support arm having a cross bar affixed transversely thereto, (b) a label holder pivotally mounted on said cross bar, said label holder having a back panel, (c) an adaptor mounted on said label support arm, said adaptor comprising (i) an abutment section adapted to contact said back panel of said label holder, and (ii) a gripping portion frictionally and slidably mounted on said label support arm, (d) said adaptor having first and second positions in which said abutment section extends forward of said label support arm by first and second distances, respectively, said second distance being greater than said first distance, and (e) said adaptor being adjustably movable to positions between said first and second positions by sliding said adaptor along said label support arm, (f) the supported angular orientation of the label holder is adjusted by changing the position of said adaptor.

2. A merchandise display hook according to claim 1, wherein said gripping portion grips the label support arm rearwardly of said cross bar and extends above a portion of the cross bar to limit the forward movement of said adaptor.

3. A merchandise display hook according to claim 2, wherein said gripping portion of said adaptor is of substantially U-shaped configuration and comprises a pair of opposed, outwardly-turned mounting guide flanges defining an entry gap for mounting of said adaptor on said label support arm.

4. A merchandise display hook according to claim 3, wherein said gripping portion is comprised of a resiliently deformable material to accommodate resilient snap-on mounting of said adaptor.

5. A merchandise display hook according to claim 4, wherein said abutment section further comprises a generally semi-circular cross-section and wherein said abutment section extends closely adjacent an underside of said label support arm.

* * * * *